US007937787B2

(12) United States Patent
Whitford

(10) Patent No.: US 7,937,787 B2
(45) Date of Patent: May 10, 2011

(54) WALL BED ASSEMBLY

(76) Inventor: Peter D. Whitford, Pasadena, CA (US)

( * ) Notice: Subject to any disclaimer, the term of this patent is extended or adjusted under 35 U.S.C. 154(b) by 0 days.

(21) Appl. No.: 12/197,741

(22) Filed: Aug. 25, 2008

(65) Prior Publication Data

US 2010/0043142 A1 Feb. 25, 2010

(51) Int. Cl.
*A47C 17/38* (2006.01)

(52) U.S. Cl. ..... 5/139; 5/133; 5/136; 5/159.1; 5/160; 5/167

(58) Field of Classification Search ..... 5/133, 136, 5/139, 159.1, 160, 167, 186.1, 236.1–238, 5/312, 906; 70/276; 24/303; 292/251.5
See application file for complete search history.

(56) References Cited

U.S. PATENT DOCUMENTS

| | | | | | |
|---|---|---|---|---|---|
| 19,449 | A | * | 2/1858 | Robbins | 5/498 |
| 1,114,849 | A | * | 10/1914 | Miller | 5/164.1 |
| 1,236,515 | A | * | 8/1917 | Welch | 5/172 |
| 5,010,622 | A | * | 4/1991 | Morita | 16/85 |
| 5,033,134 | A | * | 7/1991 | Burchett | 5/133 |
| 5,353,452 | A | | 10/1994 | Rulis | |
| 5,522,102 | A | | 6/1996 | Vayda | |
| 5,978,988 | A | | 11/1999 | Burchett | |
| 6,105,185 | A | * | 8/2000 | DiRocco | 5/164.1 |
| 6,175,975 | B1 | | 1/2001 | Bottcher et al. | |
| 6,219,863 | B1 | * | 4/2001 | Loberg et al. | 5/236.1 |
| 6,701,551 | B1 | * | 3/2004 | Antinori | 5/236.1 |

OTHER PUBLICATIONS

Create-A-Bed promotional material, obtained from www.wallbed.com on Aug. 25, 2008, original date unknown, presumably prior to Aug. 25, 2008.

* cited by examiner

*Primary Examiner* — Robert G Santos
*Assistant Examiner* — Nicholas Polito
(74) *Attorney, Agent, or Firm* — FSB Fisher Broyles

(57) ABSTRACT

A wall bed assembly including a wall cabinet and a bed frame. The bed frame is pivoted from a vertical, stored position within the wall cabinet to a horizontal position for use as a bed. The bed frame is connected to the wall cabinet with a pivot bracket secured to the bed frame which pivotally attaches to the lower end of a counterbalancing piston. The upper end of the counterbalancing piston is pivotally secured to a plate that attaches to the wall cabinet side panel. Additionally, the bed frame includes a pair of non-linear legs pivotally attached for supporting the frame in the horizontal position. The wall bed assembly also includes retractable magnets for securing the bed frame in the vertical position. A safety release position is also provided. A bed frame assembly for a customizable wall cabinet is also provided.

34 Claims, 11 Drawing Sheets

WALL BED ASSEMBLY

FIELD OF THE INVENTION

The present invention generally relates to a wall bed assembly and, more specifically, to a wall bed assembly having an improved bed frame, an improved wall cabinet, and to a bed frame which can be used in a customized wall bed cabinet.

BACKGROUND OF THE INVENTION

Busy lifestyles and the high-tech age have seen the emergence of a simpler and more modern approach to how we live our lives. This applies to both urban and suburban lifestyles. For many, urban living has become an increasingly popular lifestyle choice to simplify busy lives. Urban living environments are often less spacious than their suburban alternatives. As such, convertible furniture, such as a wall bed, is desirable in limited space environments. Such furniture permits a room to serve multiple functions by allowing a bed to be stored in a wall unit or a wall when not in use. This feature is also advantageous in more spacious environments rendering a room more versatile and multi-functional, such as for an occasional need for a bed. In commercial environments, such as hotels, multi-functioning rooms and/or rooms requiring selective extra sleeping accommodations are desirable. These requirements are achieved with the addition of a wall bed.

Typically, wall beds include a bed frame and a wall cabinet for housing the bed frame. The bed frame is moveable from a generally vertical or stored position within the cabinet, to a horizontal position for use as a bed. Common features among prior art wall beds include counter-balancing springs or pistons for counter balancing the weight of the bed frame and bed so that the bed frame may be easily raised into a stored position. Counter balancing springs or pistons also assist in positioning the bed for use so as to counteract the gravitational forces of the bed as it is being drawn downward. Prior art wall beds include legs to support the bed in use but which often are fixedly mounted to the bed frame such that they protrude outward when the bed is in the stored position, thereby adversely effecting the profile of the stored bed. Also common to prior art wall beds are beds having excessive weight resulting from complicated mattress support spring systems and complicated structures which adversely impacts the ease at which the bed may be moved from a stored to a useable position and vice versa The excessive weight of prior art wall beds renders them cumbersome to manipulate and, in some instances, renders them unsafe such as when the bed is released from a vertical position to a horizontal position. Without precautionary measures, the weight of the bed frame and mattress can pivot downward with great force, even with counterbalancing pistons, which can be especially problematic if the bed is unintentionally released. Prior art wall beds include bed frames permanently mounted to the wall cabinets. Accordingly, the bed frame is only provided with a certain cabinet preventing use of the bed frame within a customized cabinet or other housing structure.

For example, U.S. Pat. No. 5,033,134 to Burchett (hereinafter "the '134 Patent") is directed to a cabinet wall bed including a cabinet, a bed frame, a counterbalancing system and a leg-locking and supporting system. The leg-locking and supporting system is an intricate system including numerous components and extends from the underside of the bottom bed frame support. The leg-locking system according to the '134 Patent includes, in addition to numerous other components, a spring loaded leg support which is also the handle for moving the bed to and from the stored position, and which cooperates with a locking bar to secure the bed frame in a stored position. To pivot the bed frame to a vertical position, the complicated handle and leg is manually forced shut against compressive forces of the spring, and the bed is lifted. Assumedly this would require the user to reach beneath the bed frame to apply sufficient force to overcome the compression springs of the intricate leg-locking system to disengage the legs and use the legs as a handle to pivot the bed frame. Moreover, should the leg-locking system be unintentionally dislodged from the locking bar, the bed rotates to the horizontal position with no interim safety position.

Additionally, U.S. Pat. No. 5,353,452 to Rulis (hereinafter "the '452 Patent") is directed to a folding bed assembly including a shell (or cabinet) and a bed pad for supporting a mattress. The shell includes a two piece outer, front surface including the underside of the bed pad and a separate foot which extends across the width of the bed pad and which serves as the uppermost portion of the outer, front surface. The relatively large "foot" according to the '452 Patent is pivotally connected to the outer surface of bed pad by a hinge such that when the handle of the "foot" is pulled downward, the bed pad pivots toward the horizontal position and the "foot" swings under forces of gravity to extend perpendicularly from the bottom and across the full width of the bed pad.

SUMMARY OF THE INVENTION

In accordance with preferred embodiments of the present invention, a wall bed assembly for mounting on a wall including a wall cabinet and a convertible bed frame assembly is provided. The wall cabinet includes a pair of side panels, an upper surface, and an anterior panel. The bed frame is secured to an interior surface of the anterior panel and the bed frame is pivotally connected to the wall cabinet to pivot from a first, substantially vertical position wherein the bed frame is stored in the wall cabinet to a second, substantially horizontal position wherein the bed frame and the anterior panel are positioned to support a mattress for use as a bed.

The bed frame is pivotally connected on each side to the wall cabinet side panels by a unique combination of components comprising a first upper bracket, a second pivot bracket, a counterbalancing piston, and a fixed plate. The first bracket is generally circular and is attached to the wall cabinet side panel to pivotally connect an upper end of the counterbalancing piston to the wall cabinet. The bottom end of the counterbalancing piston is pivotally secured to the second, pivot bracket. The second pivot bracket extends upwardly from the bed frame side member and defines a fulcrum receiving aperture and a piston receiving aperture. Securing means are provided to secure the counterbalancing piston to the piston receiving aperture of the pivot bracket. The fixed plate is secured to the wall cabinet side panel and includes an outwardly extending fulcrum member. The fulcrum member of the fixed plate is received within the fulcrum receiving aperture of the second pivot bracket and securing means pivotally connects the pivot bracket to the fixed plate. Accordingly, the bed frame pivots about the fulcrum member as the bed frame and anterior panel are moved between the vertical, stored position and the horizontal position for use as a bed. These positions, including a third, safety release position described below, are readily assumed, at least in part, due to the counterbalancing pistons which counterbalance the gravitational forces acting on the bed frame when the bed is being lowered. The pistons also counterbalance the effect of gravitational forces and the weight of the bed frame by allowing the bed to be pivotally raised without excessive force.

In the substantially horizontal position, the bed frame and anterior panel are supported by a pair of legs, one each located along the side of each bed frame side members. The legs are uniquely configured and uniquely secured to the bed frame such that the legs assume a supportive position due to gravitational forces. More specifically, the legs are pivotally secured to each side member such that they pivot from a position substantially parallel to the side member to a position generally perpendicular thereto to support the bed frame upon the floor surface. The legs are uniquely configured to be non-linear and include an angular outer edge. A stop is provided to prevent over rotation of the legs and to prevent wear of the anterior panel.

A securing mechanism including at least one, and preferably two, retractable magnets and an extendable shaft are provided on the upper surface of the wall cabinet to secure the wall bed assembly in the stored position and to prevent unintentional or accidental pivoting of the bed frame toward the horizontal position. The retractable magnets cooperate with the bed frame foot rail to secure the wall bed assembly. Pressure applied to the anterior panel releases the magnets from the foot rail and the extendable shaft urges the anterior panel and bed frame forward. The anterior panel and bed frame are released only to a safety release position, that is, about six inches from the vertical. This is achieved by the unique configuration of the various components of the wall bed in combination with the counterbalancing pistons. The bed frame and anterior panel may then manually be further pivoted toward the horizontal position. This feature further ensures the safety of the user of the wall bed in that, even if the bed frame is unintentionally removed from the vertical position, the bed frame does not pivot to the horizontal position without additional, intentional forces supplied by the user.

The unique configuration of the bed frame and its novel connection to the wall cabinet renders the bed frame fully convertible and customizable. The bed frame is generally lightweight and may be secured to conventional wall frames with only minor modifications thereto. Therefore, the convertible bed frame may be provided to be installed into an existing wall cabinet or permanent wall structure.

DETAILED DESCRIPTION OF THE INVENTION

The present invention will now be described in detail hereinafter by reference to the accompanying drawings. The invention is not intended to be limited to the embodiments described; rather, this detailed description is provided to enable any person skilled in the art to make and use the invention.

Figure 1:
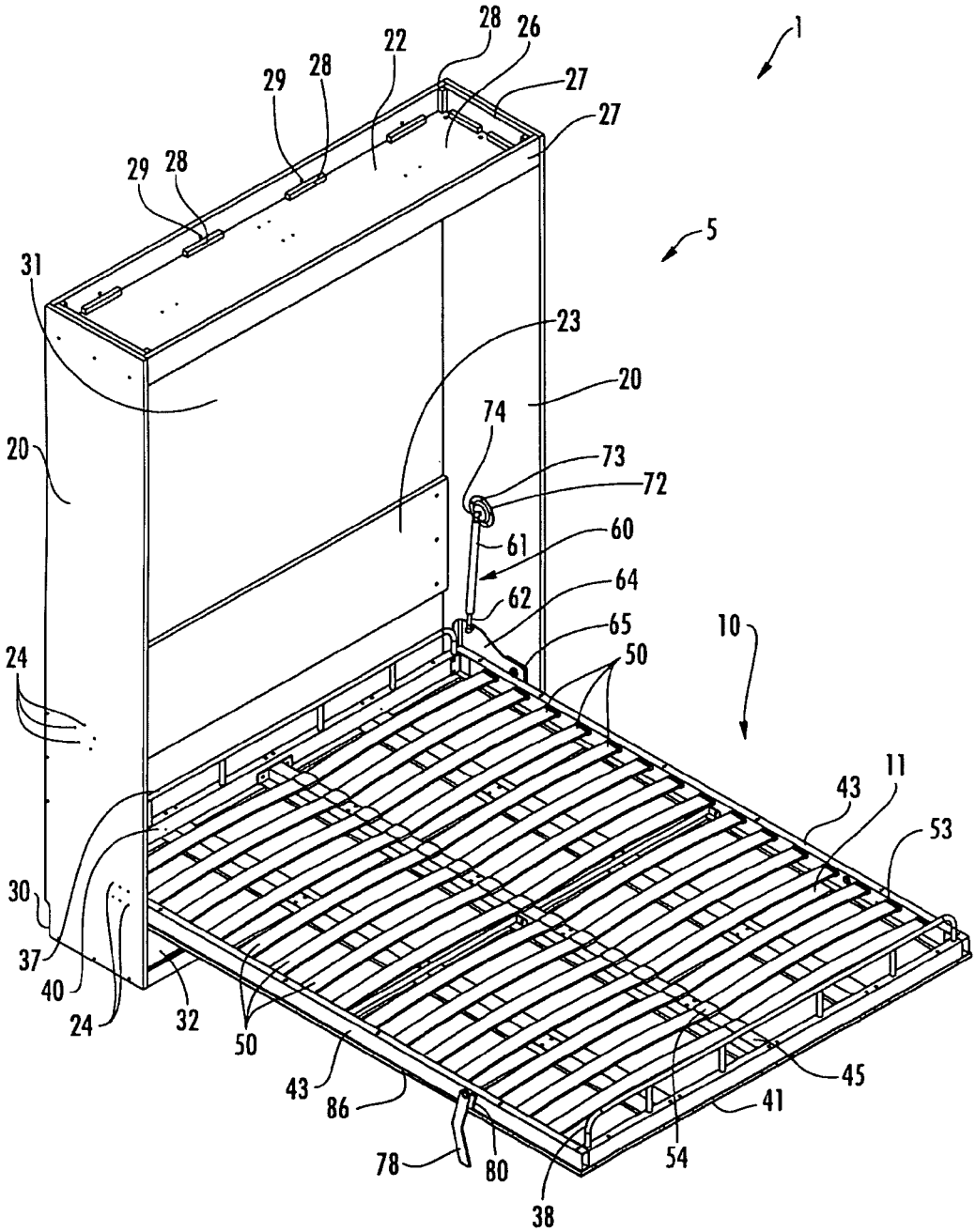
FIG. 1 is a perspective view of the wall bed assembly according to the present invention with a convertible bed frame in a horizontal position for use as a bed.
Figure 2:
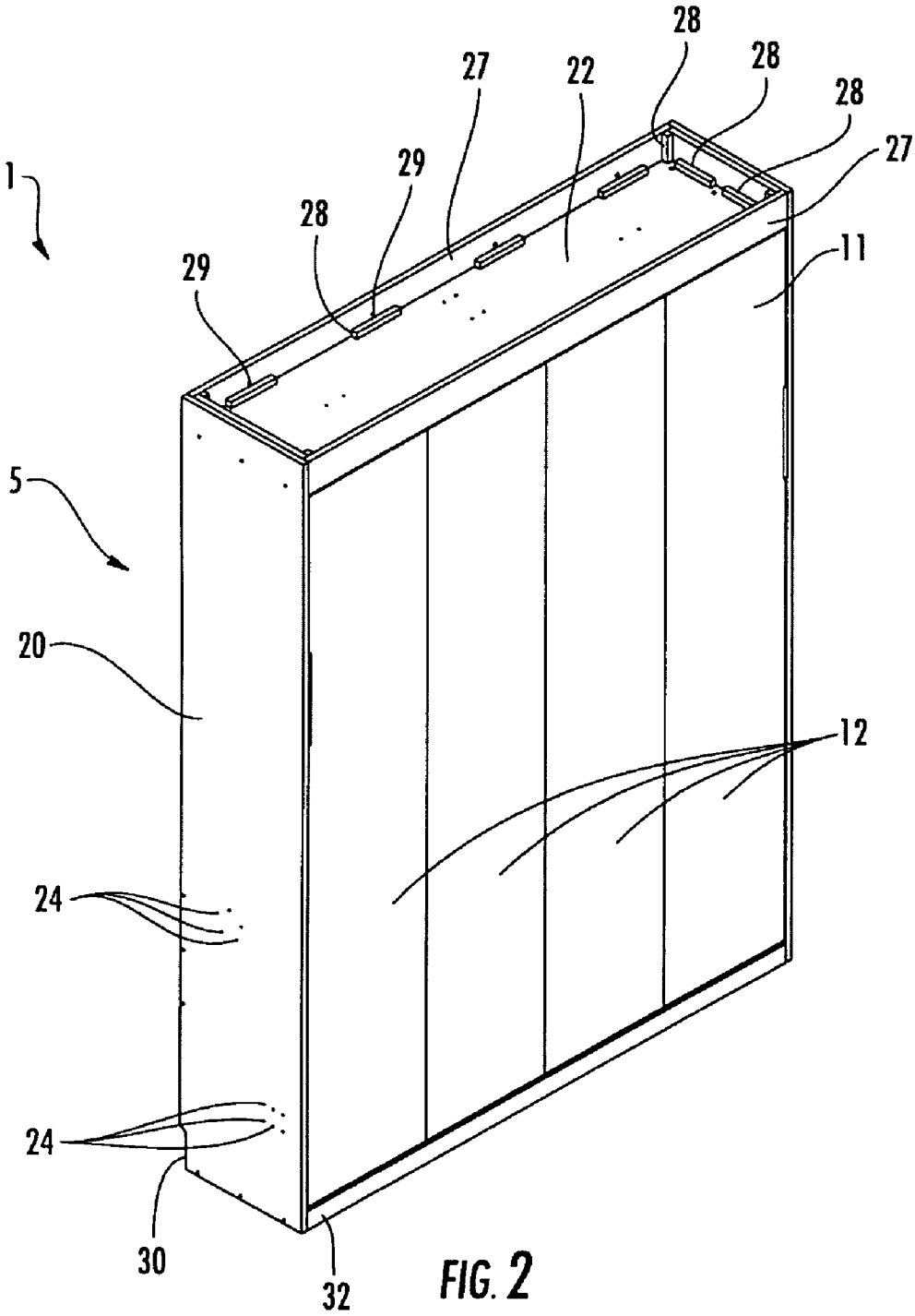
FIG. 2 is a perspective view of the wall bed assembly with the convertible bed frame in a vertical, stored position.

In FIGS. 1 and 2, a wall bed assembly 1 is shown which embodies the present invention and which comprises a wall cabinet 5 and convertible bed frame 10. The wall cabinet 5 supports the bed frame 10 in a substantially horizontal position for use as a bed as shown in FIG. 1 and supports and stores the bed frame 10 in a substantially vertical or stored position as shown in FIG. 2. The wall cabinet 5 is substantially rectangular in the vertical, stored position, as shown in FIG. 2, and includes a generally planar anterior panel 11 which supports the bed frame 10 and serves as a base therefore in the substantially horizontal position.

Figure 4:
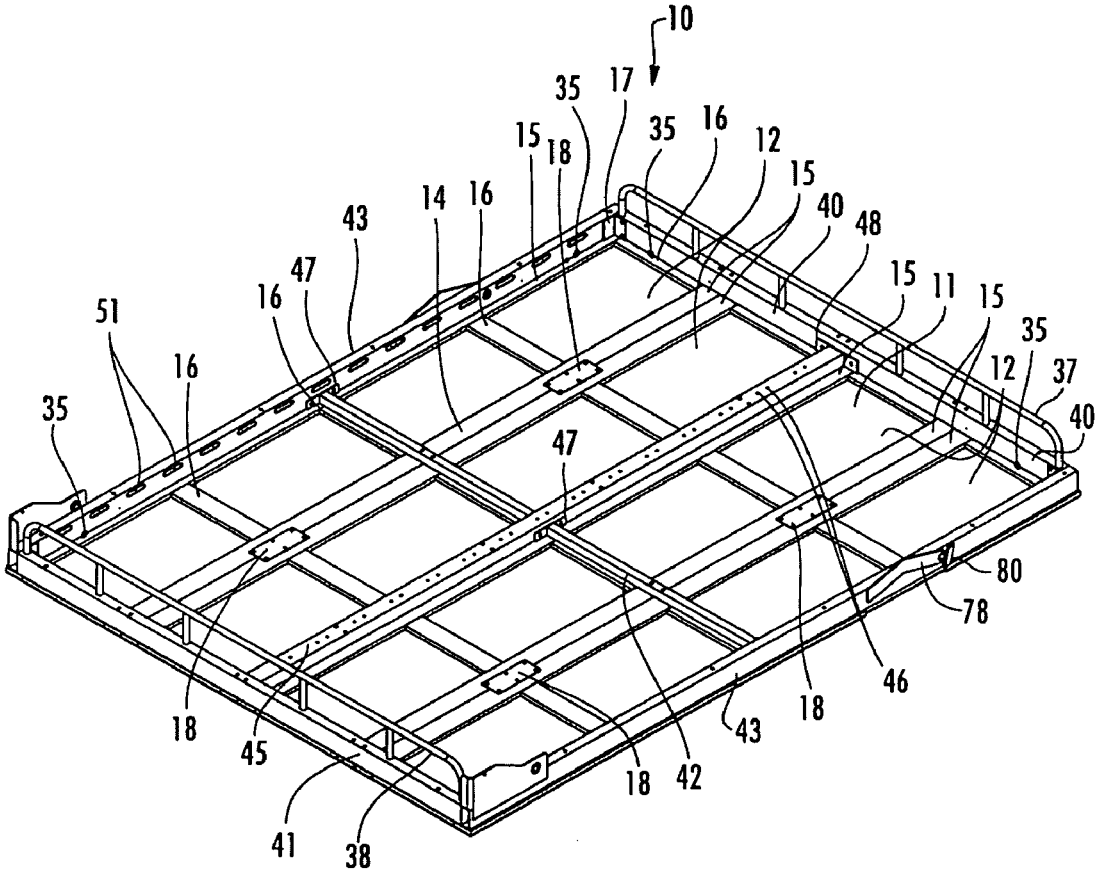
FIG. 4 is a perspective view of a portion of the bed frame assembly according to the present invention.
Figure 5:
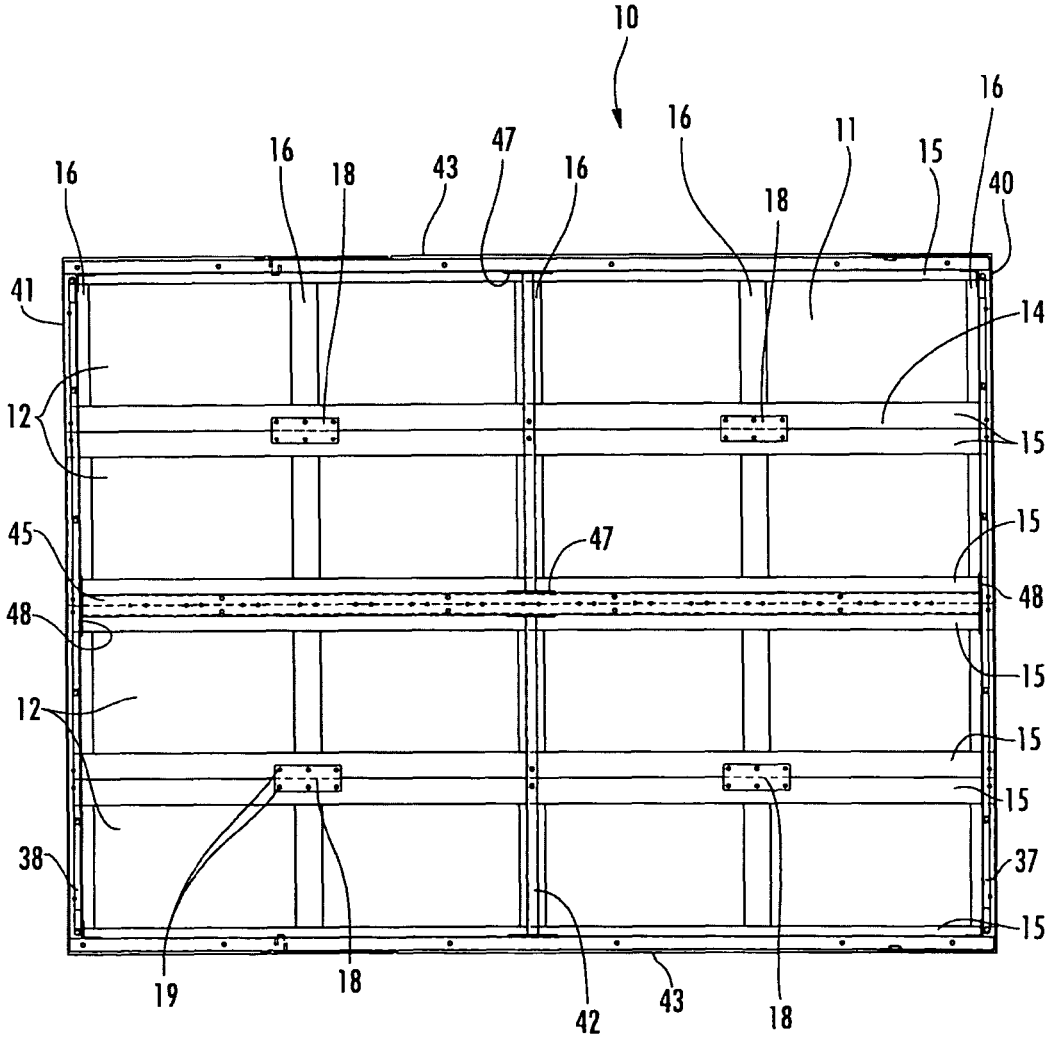
FIG. 5 is a top plan view of the bed frame assembly according to FIG. 4.

The anterior panel 11 advantageously is defined by a plurality of anterior members 12 and, preferably, four anterior members 12 (as shown). The anterior members 12 provide the exterior, aesthetic appearance of the wall cabinet 5 in the vertical position as best shown in FIG. 2. The anterior members 12 may be formed of any material providing the desired aesthetics of the wall bed assembly 1. For example, wood provides a preferred material as it may be stained or painted to achieve the desired furniture appearance. Alternatively, less traditional furniture material may be selected such as, but not limited to, plastic or metallic materials. As shown, the four anterior members 12 are positioned adjacent one another. An anterior surface frame 14 is secured to the upper surface of the anterior panel 11 surface (in the generally horizontal position) to structurally support the anterior members 12 as shown in FIGS. 4 and 5. Of course, if the anterior surface is formed of a material providing sufficient inherent strength, the need for an anterior surface frame is obviated.

The anterior surface frame 14 is defined by longitudinally extending frame members 15 which extend along the sides of each anterior member 12 shown in FIG. 4. The anterior surface frame 14 also includes laterally extending frame members 16 which extend across the width thereof to provide additional structural support to the anterior panel 11. Adjacent anterior members 12 are secured to one another along the longitudinally extending frame members 15, preferably at the location along the length of the anterior members 12 which intersects with the laterally extending frame members 16 as shown in FIGS. 4 and 5. The anterior members 12 are secured to one another by a plurality of plates 18 which may be formed of a suitable material, such as metal. The plates 18 include preformed apertures 19 for receipt of securing means, such as wood screws. As shown in the various figures, six apertures 19 are provided. The anterior surface frame 14, therefore, has a grid-like configuration, but it is within the scope of the present invention to provide only longitudinally extending frame members, only laterally extending frame members, diagonally extending frame members (not shown) or no frame members.

Figure 3:
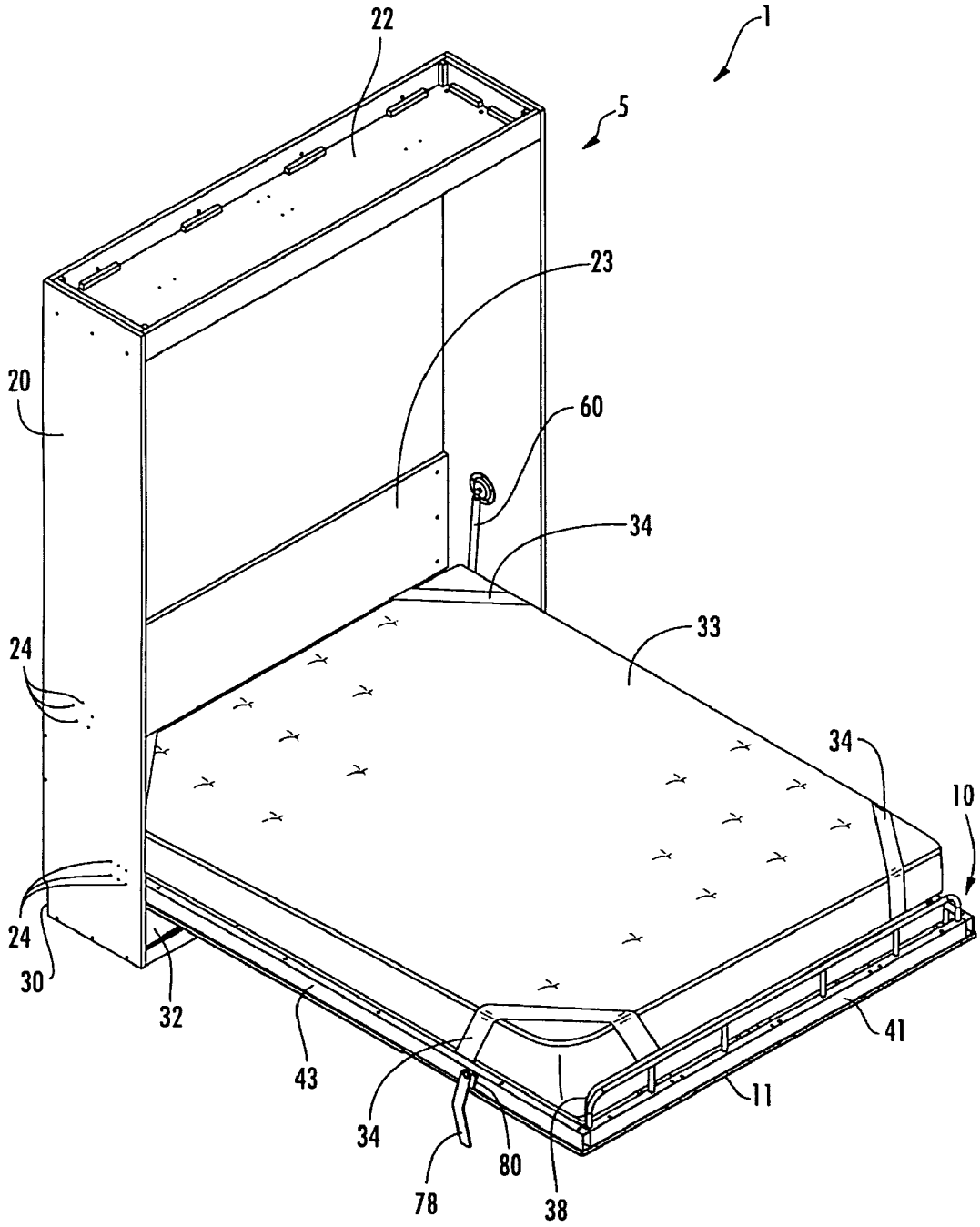
FIG. 3 is a perspective view of the wall bed assembly with a convertible bed frame in the horizontal position with a mattress positioned thereon for us as a bed.

The wall cabinet 5 also includes a pair of side panels 20, an upper surface 22, and a posterior brace 23, shown in FIGS. 1 and 3, formed of suitable materials, such as wood, to provide the desired aesthetic appearance. The side panels 20 include piston receiving apertures 24, described fully below, and support the upper surface 22 of the wall cabinet 5. The side panels 20 may also be configured along the bottoms thereof to correspond with base moldings of the wall upon which it will be supported. For example, cutouts 30 may be defined by the side panels 20 to accommodate a particular base molding of a wall to provide a custom, flush fit.

As shown in FIG. 2, the upper surface 22 of the wall cabinet 5 extends between the side panels 20 and is generally quadrilateral having a horizontal planar member 26 and vertically extending planar members 27. A plurality of supports 28 are provided to further support the wall bed assembly 1, such as when it is secured to a permanent structure, such as a wall. The supports may be formed of any strengthening material, preferably wood, or alternatively, metal. The rear vertical planar surface 27 therefore provides means for anchoring the wall bed assembly to a wall. Accordingly apertures 29 may be provided for receiving securing means.

Figure 13:
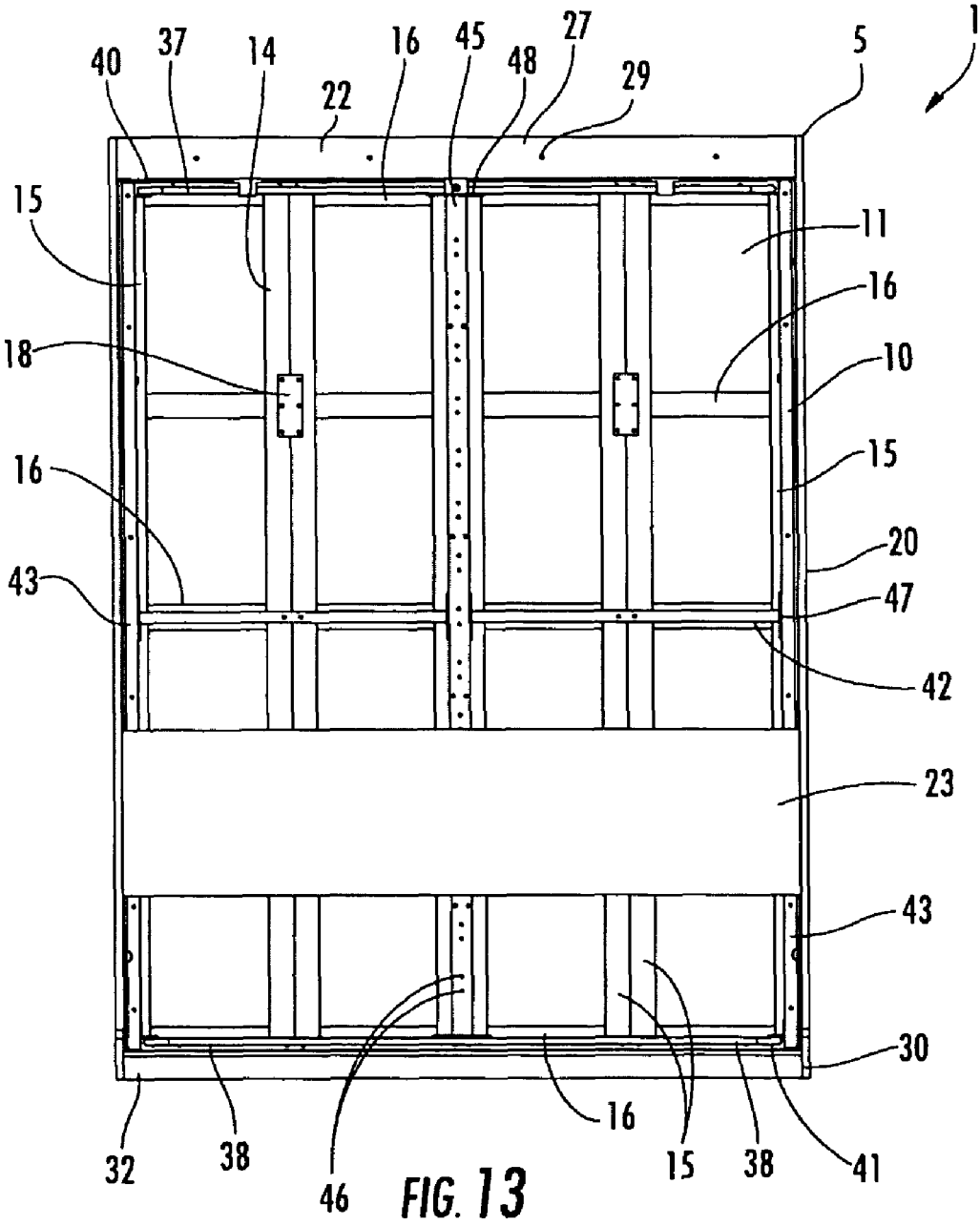
FIG. 13 is a rear plan view of the bed frame shown in the vertical, stored position within the wall cabinet.

The posterior brace 23 extends between the side panels 20 and braces the wall cabinet 5. As shown in FIG. 13, the posterior brace 23 defines the posterior surface of the generally rectangular wall cabinet 5. Accordingly, a wall surface behind the wall bed assembly would be visible between the side panels 20 when the bed is in the substantially horizontal position as shown in FIG. 1. Alternatively, a full length posterior surface 31 may be provided upon which the posterior brace 25 may optionally be secured thereto. A lower surface 32 is also provided to support the wall cabinet 5 upon a floor surface.

The bed frame 10 is supported and stored by the wall cabinet 5 and supports a mattress 33 to provide a bed when the bed frame 10 is in the generally horizontal position as shown in FIG. 3. Four mattress straps 34 are provided on the bed frame 10 to secure the corners of the mattress 33. Preferably the mattress straps 34 are elastic so as to restrain the mattress firmly in place. A pair of apertures 35 is provided adjacent each bed frame corner for receipt of securing means, such as a screw and washer, to secure the elastic mattress straps 34 to the bed frame 10. The apertures 35 are positioned a predetermined distance from the bed frame corners so as extend along a significant portion of the mattress corner to prevent unintentional sliding of the mattress straps while simultaneously being positioned to permit easy assembly of the mattress 33 to the bed frame 10.

The bed frame 10 includes a pair of laterally extending members, one member 40 defining the head of the bed frame 10 and one member 41 defining the foot of the bed frame 10 as shown in FIG. 4. The laterally extending members 40, 41 respectively support a head rail 37 and a foot rail 38. A laterally extending medial member 42 is also provided. The bed frame 10 also includes a pair of longitudinally extending side members 43 and a longitudinally extending medial member 45. The longitudinally extending side members 43 are secured to the laterally extending members 40, 41 in a generally rectangular relationship. Preferably, the bed frame 10 is formed of metal. The members are connected by any securing means, such as welding a bracket 17 to the head frame member 40 and foot frame member 41. The bracket 17 includes apertures for receiving connecting means, such as a bolt and nut, for securing the respective side member 43 to the respective laterally extending member 40 or 41.

The laterally extending medial members 42 comprises a pair of members, each extending between the respective side member 43 and the longitudinally extending medial member 45. Each laterally extending medial member 42 comprises a plate 47 defining apertures for receiving securing means, such as a bolt and nut, to secure the laterally extending medial member to the respective side member 43 and longitudinally extending medial member 45. Similarly, the longitudinally extending medial member 45 includes a plate 48 on each end thereof having apertures for receiving securing means for securing the longitudinal medial member 45 to the head frame member 40 and foot frame member 41. These bed frame members, as best shown in FIG. 5, therefore form quadrants for supporting the mattress 33. The laterally extending members, 40, 41, 42 and the longitudinally extending members 43 and 45 may be formed of any suitable material but are, preferably, formed of metal. The bed frame 10 is secured to the anterior panel 11 by securing means, such as screws, which extend through the apertures provided along each of the frame members as shown in FIG. 4. The securing means extend through the bed frame 10 and into the anterior surface frame 14 but do not substantially extend through the anterior panel 11 to provide a smooth exterior finish.

Secured to the bed frame 10 is a plurality of slats 50 for supporting the mattress 33 as shown in FIG. 1. The slats 50 extend between a respective side member 43 and the longitudinal medial member 45. The bed frame 10 preferably has an equal number of slats 50 on each side of the longitudinal medial member 45. Preferably each slat 50 is of a length slightly greater than the distance defined between a side member 43 and the longitudinal medial member 45, but less than the width defined by the distance between the pair of side members 43. Therefore, when the individual slats are secured to a side member 43 and the longitudinal medial member 45, they bow upward as shown in FIG. 1, to resiliently support the mattress 33. The slats 50 may be formed of any pliable material having sufficient strength to support the mattress and the weight of a person or persons using the wall bed assembly 1. According to the preferred embodiment of the present invention, the plurality of slats 50 is formed of pliable wood.

Although it is within the scope of the invention to provide any number of slats 50, in the preferred embodiment shown in FIG. 1, thirty slats are provided forming two columns of fifteen slats each. Obviously, the support provided beneath the mattress 33 may be adjusted by altering the number of slats, e.g., providing less slats to provide less firm support for the mattress 33. Likewise the length of each slat 50 may be adjusted to alter the degree at which each slat bows upward, or it may not bow at all. Alternatively, half the number of slats may be provided whereby each individual slat 50 extends the distance between the side members 43. In such circumstance, if the slat is formed of a sufficiently pliable material, the middle of each slat may be secured to the longitudinal medial member to produce to a configuration similar to that shown in FIG. 1. Alternatively, the longer slat 50 may bow only slightly, or not at all, and not be secured to the longitudinal medial member.

Figure 6:
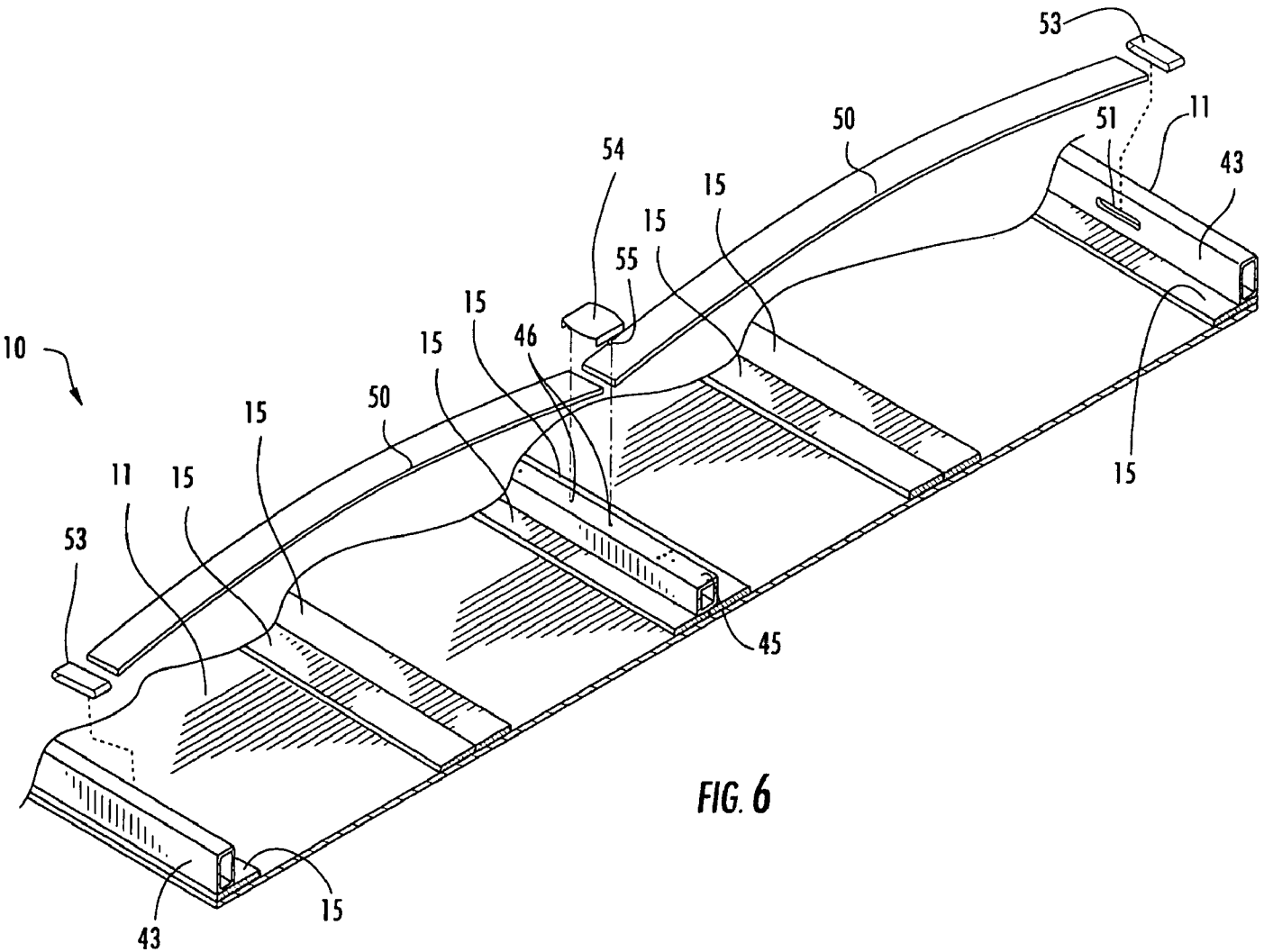
FIG. 6 is an exploded view of the bed frame assembly illustrating the slat connection to the bed frame.

FIG. 6 is an exploded view illustrating the connection of the slats 50 to the bed frame 10. The longitudinally extending side members 43 of the bed frame 10 comprise apertures 51 for receiving distal ends of the slats 50. The longitudinally extending medial member 45 also includes a plurality of apertures, thirty apertures as shown, for securing the medial ends of the bed slats 50. A plurality of bushings 53 are provided within the apertures 51 of the bed frame side members 43 to frictionally secure the distal ends of the slats 50. The bushings 53 are configured to receive the slats and frictionally secure the slats within the apertures 51 and prevent wearing of the bed frame side member 43 and bed slats 50. The bushings are formed of any suitable material, such as plastic, rubber, metal, etc. Preferably, the bushings are formed of rubber. A plurality of brackets 54 are provided and are configured to enclose the medial ends of the respective bed slats 50 and secure the slats 50 to the longitudinally extending bed frame member 45. The brackets 54 include a pair of extensions 55 which are configured to be matingly received by the apertures 46 of the longitudinal frame member 45 and secure the slats 50 to the bed frame 10. The slats 50 therefore may be inserted within the respective bracket 54, bent slightly to bow upward, and then inserted into the respective bushing 53. Alternatively, the slate 50 may be inserted into the bushing 53 first.

Figure 7:
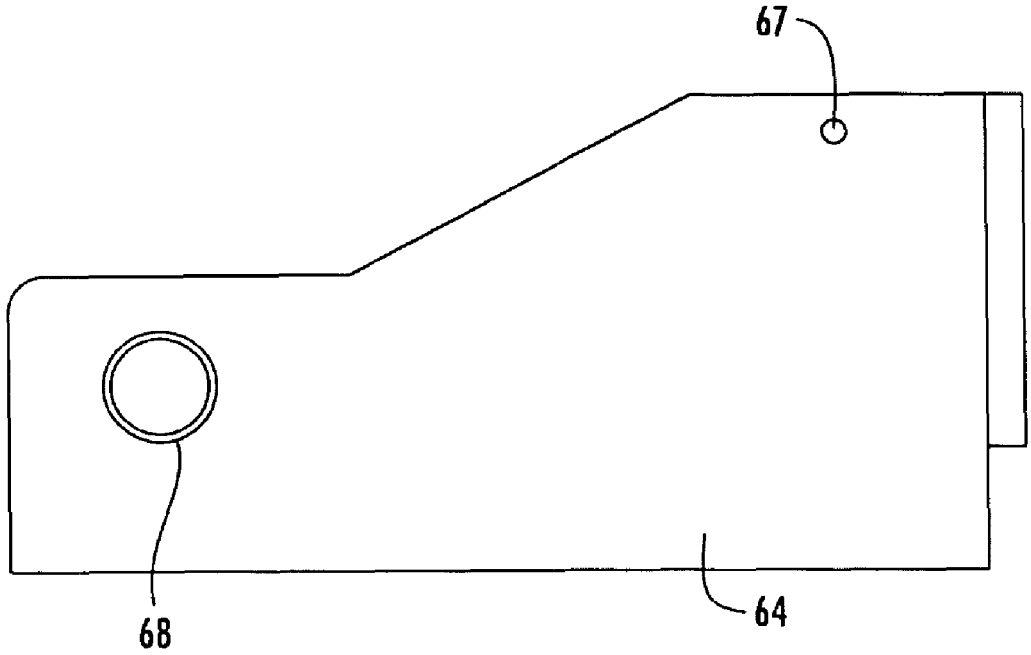
FIG. 7 illustrates the pivot bracket for connecting the bed frame to the wall cabinet.

The bed frame 10 is attached to each side panel 20 of the wall cabinet 5 by a counterbalancing piston 60, a first upper bracket 72, a second pivot bracket 64, and a fixed plate 65. As shown in FIGS. 1 and 9, the upper end of each piston 60 is secured to the respective side panel 20 and the lower end of each piston 60 is secured to the bed frame 10. In a preferred embodiment, each piston 60 is a gas filled piston comprising a compression chamber housing 61 and an extendable piston arm 62. The lower end of each piston 60 is pivotally secured to the respective side member 43 of the bed frame 10 by a pivot bracket 64 and a fixed plate 65 as shown in FIGS. 7 and 8, respectively.

Figure 8:
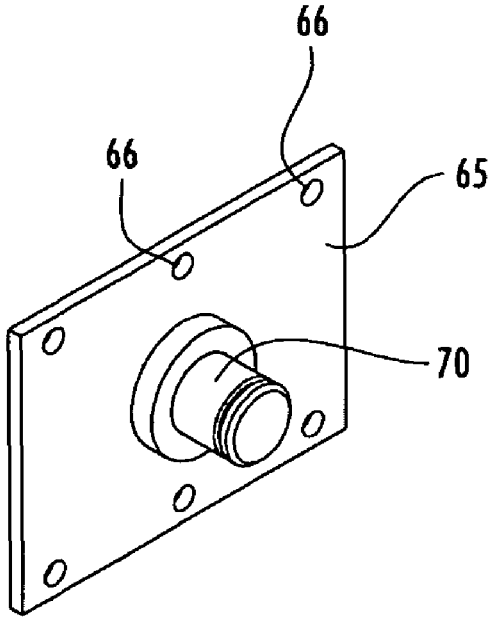
FIG. 8 illustrates the fixed plate for connecting the bed frame to the wall cabinet.
Figure 9:
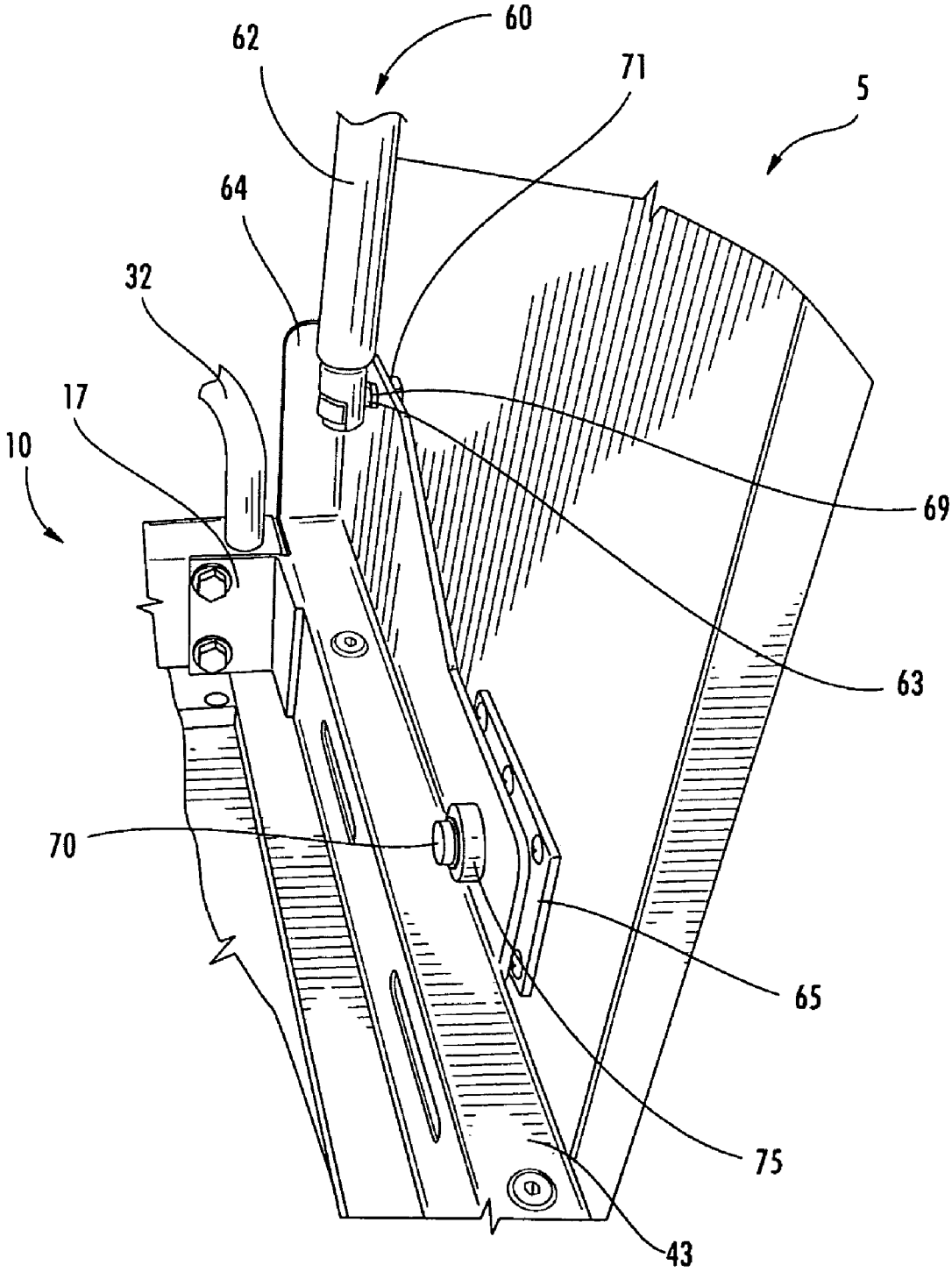
FIG. 9 illustrates the unique connection of the bed frame to the wall cabinet.

As shown in FIG. 8, the fixed plate 65 includes apertures 66 which correlate with the lowermost piston receiving apertures 24 of the side panels 20. The fixed plate 65 also includes a perpendicularly extending fulcrum member 70 having a threaded end. Securing means, such as bolts and nuts, secure the fixed plate 65 to the side panels 20 of the cabinet 5. The pivot bracket 64 is secured to the bed frame by any means, preferably welded.

The piston arm 62, at its bottom portion, includes a generally perpendicularly extending member 63. The pivot bracket 64 includes a piston arm receiving aperture 67 for receiving the perpendicular member 63 extending from the piston arm 62 and securing means 71, such as a threaded nut, pivotally secures the bottom end of the piston 60 to the fixed plate 65. A spacer 69 is provided, and is secured to the pivot bracket 64, e.g., welded thereto, to properly position the piston 60 and the fixed plate 65 such that the piston 60 pivots relative to the fixed plate 65 about the perpendicular member 63.

The second bracket 64 also includes a fulcrum member receiving aperture 68 for receiving the fulcrum member 70 of the fixed plate 65. When the pivot bracket 64 is positioned on the fixed plate 65 such that the fulcrum member 70 extends through the corresponding pivot bracket aperture 68, securing means 75, such as a nut, is threaded onto the threaded fulcrum member 70 to secure the two plates in pivotal relationship. The fulcrum member 70 serves as the fulcrum, or point at which the bed frame pivots, when it is converted from the stored, vertical position to the horizontal position and back again. The upper end of each piston 60 is pivotally connected to the side panel 20 of the wall cabinet 5 by a circular bracket 72 having apertures 73 corresponding to the uppermost piston receiving apertures 24 of the wall cabinet as shown in FIG. 1. The circular bracket 72 preferably has a perpendicularly extending member 74 having a ball mounted end to be received by a ball receiving member of the piston 60 to pivotally connect the piston 60 to the wall cabinet 5.

The counterbalancing pistons 60 provide an appropriate resistive force to the downward acting gravitational force acting on the bed frame 10 and mattress 33. The pistons 60 assist in both the lowering of the bed frame 10 and mattress 33 for use as a bed and lifting the components to the vertical, stored position. The pistons 60 become compressed as the bed frame 10 is lowered, as discussed in more detail below, thus counteracting the force of gravity, enabling the bed frame 10 and mattress 33 to be controllably pivoted by the user from the vertical to the horizontal positions. Additionally, due to the compressive forces of the gas pistons 60, the user need supply only nominal force to overcome the weight of the bed frame 10 and mattress 33 and easily raise the bed to a vertical position. In order to pivot the bed frame 10 from the horizontal to the vertical position, a residual lifting force is required thereby preventing unintentional closing of the wall bed assembly 1. The pistons 60 are selected to exert the necessary compressive forces to perform the aforementioned functions, for example, between 550 and 750 lbs per square inch, preferably compressive forces of 650 lbs. per square inch. The force requirement of the pistons 60 and the position thereof may be adjusted to balance properly the bed frame 10 within the wall cabinet 5.

Figure 10:
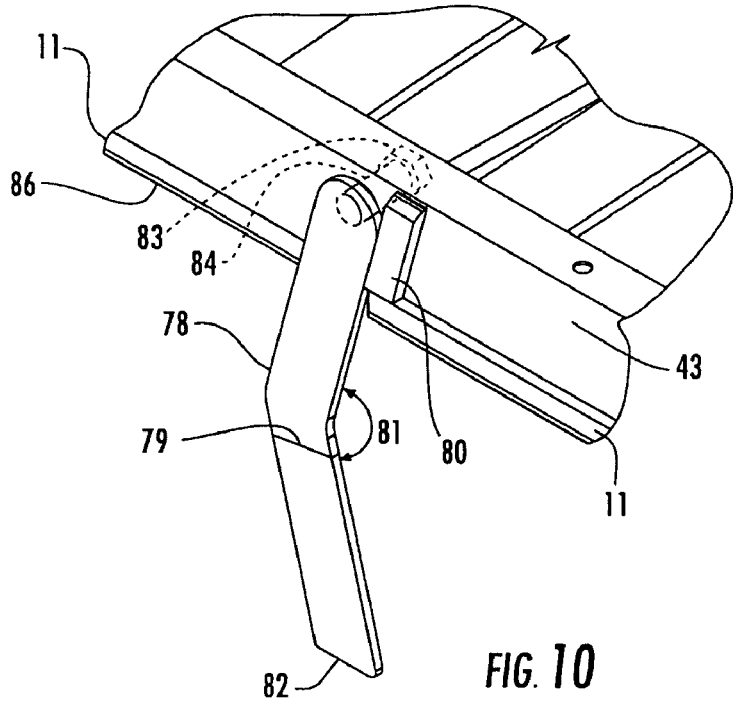
FIG. 10 is an enlarged perspective view of the leg support of the bed frame assembly shown in FIG. 1.

When the bed frame 10 (and mattress 33) is pivoted from the vertical, stored position to the substantially horizontal position for use as a bed, it is supported, at its outermost, or foot, end by a pair of legs 78 shown in FIG. 10. The legs 78 are non-linear, having a configuration defining an angle 81 which preferably is an obtuse angle. The angle 81 may be selected between about 175° to about 95°, preferably between 160° and 140°, and most preferably about 150°. The legs 78 include an angular end 82 to be substantially flush, or parallel, to the floor surface when the bed frame 10 is supported thereon. The legs 78 include a perpendicularly extending pivoting means 84, shown in phantom in FIG. 10, which extend through the corresponding apertures of the side member 43. A securing means 83, such as a nut, pivotally secures the leg 78 to the side member 43 and is preferably located on an inner edge of the side member 43, between adjacent side frame apertures 51. Alternatively, the legs 78 may include an aperture for receiving a separate connecting means to provide a pivotal connection between the bed frame 10 and the legs 78. The legs 78 are also configured to have a sufficient weight so that as the bed frame 10 is lowered, the weight of the leg 78, under gravitational forces, assumes a supportive position, i.e., it pivots from a position generally parallel to the side member 43 of the bed frame 10 to a position generally perpendicular to the side member 43 to support the bed frame upon the floor surface. The legs 78 may be formed of any suitable material having sufficient weight to assume the supporting position under gravitational forces as the bed frame 10 is lowered to the horizontal position and support the bed in use. Preferably the non-linear legs 78 are formed of metal and may also preferably be coated with a protective outer surface 79 such as a plastic, e.g., polyvinyl chloride.

To prevent over rotation of the legs 78, a stop 80 is provided. The stop 80 is positioned and configured to abut the upper portion of the legs 78 and is supported on the side member 43 of the bed frame 10. As shown in FIG. 10, the stop 80 protrudes outward from the side member 43 and is a parallelogram such that it has a surface for abutting the leg 78 which is positioned at substantially the same angle from the vertical as the upper portion of the leg 78. The stop 80 may be formed of any suitable material and may be formed as a separate structure or formed as a protrusion of the side members 43. Preferably, the stops 80 are formed as a protrusion of the side members 43 and are therefore formed of metal. To accommodate the legs 78 in all of its positions, the anterior panel 11 of the wall cabinet 10 includes a cutout or guide 86. The stop 80, preferably being formed of a stronger material than the anterior panel 11, provides the additional benefit of preventing wear of the anterior panel 11.

Figure 11:
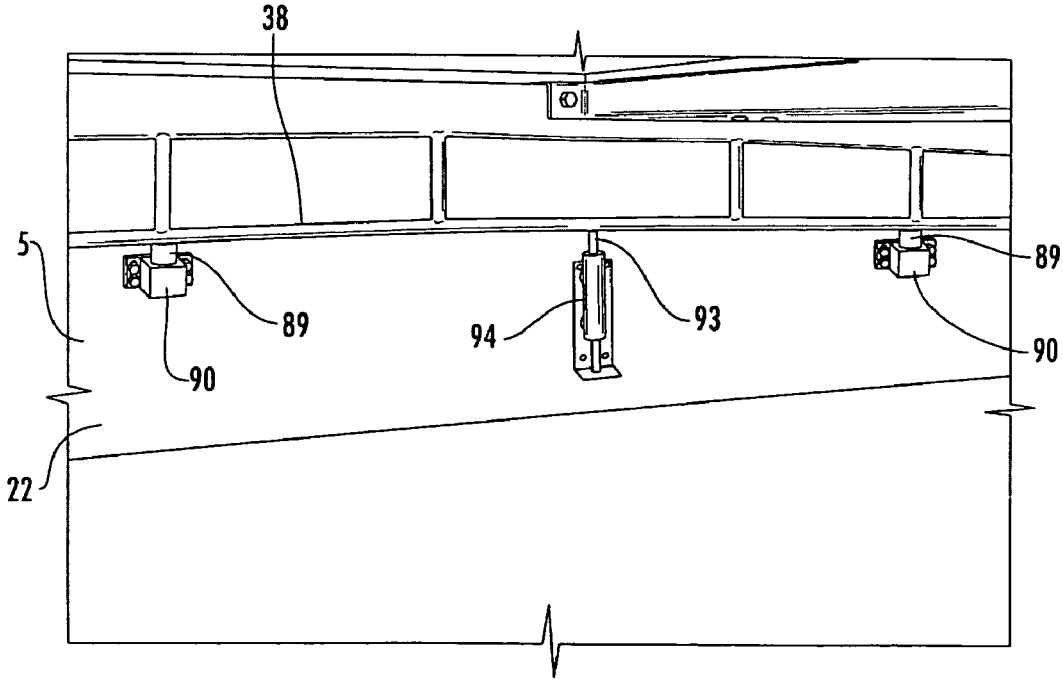
FIG. 11 is a bottom perspective view of the wall cabinet upper surface which supports the securing assembly to secure the bed frame assembly in the stored, vertical position.

The guides 86 are defined by each side edge of the anterior panel 11 of the wall cabinet 5. This permits the legs 78 to assume a stored position, that is, extending adjacent the side member 43, when the bed is in the stored, vertical position as shown in FIGS. 4 and 11. The cutout 86 permits the leg 78 to freely pivot between the vertical and horizontal positions free of interference from the anterior panel 11.

The wall bed assembly I according to the present invention provides a bed frame 10 which is securely retained within the wall cabinet 5 in the vertical, stored position as shown in FIGS. 10 and FIG. 13. FIG. 11 depicts the upper surface 22 of the wall cabinet 5 as viewed from within the wall cabinet 5 looking upward in the direction of the bottom side of the upper surface 22. Mounted upon the bottom of the upper surface 22 is a pair of retractable magnets 89 received within respective magnet housings 90 and an extendable shaft 93. Preferably, the magnet housings 90 are formed of wood. As the bed frame 10 approaches the substantially vertical position, the magnets 89 attract the metal foot rail 38 securing the bed frame 10 in the vertical, stored position. A single magnet or any number of magnets may be provided. Preferably, as shown, two magnets are provided to maintain the bed cabinet in the stored position and presenting the anterior panel 11 of the wall cabinet 5 substantially flush with the front vertical planar member 27 of the wall cabinet 5. Contact of the foot rail 38 to the extendable shaft 93 exerts force upon the shaft 93 causing it to extend rearward.

Figure 12:
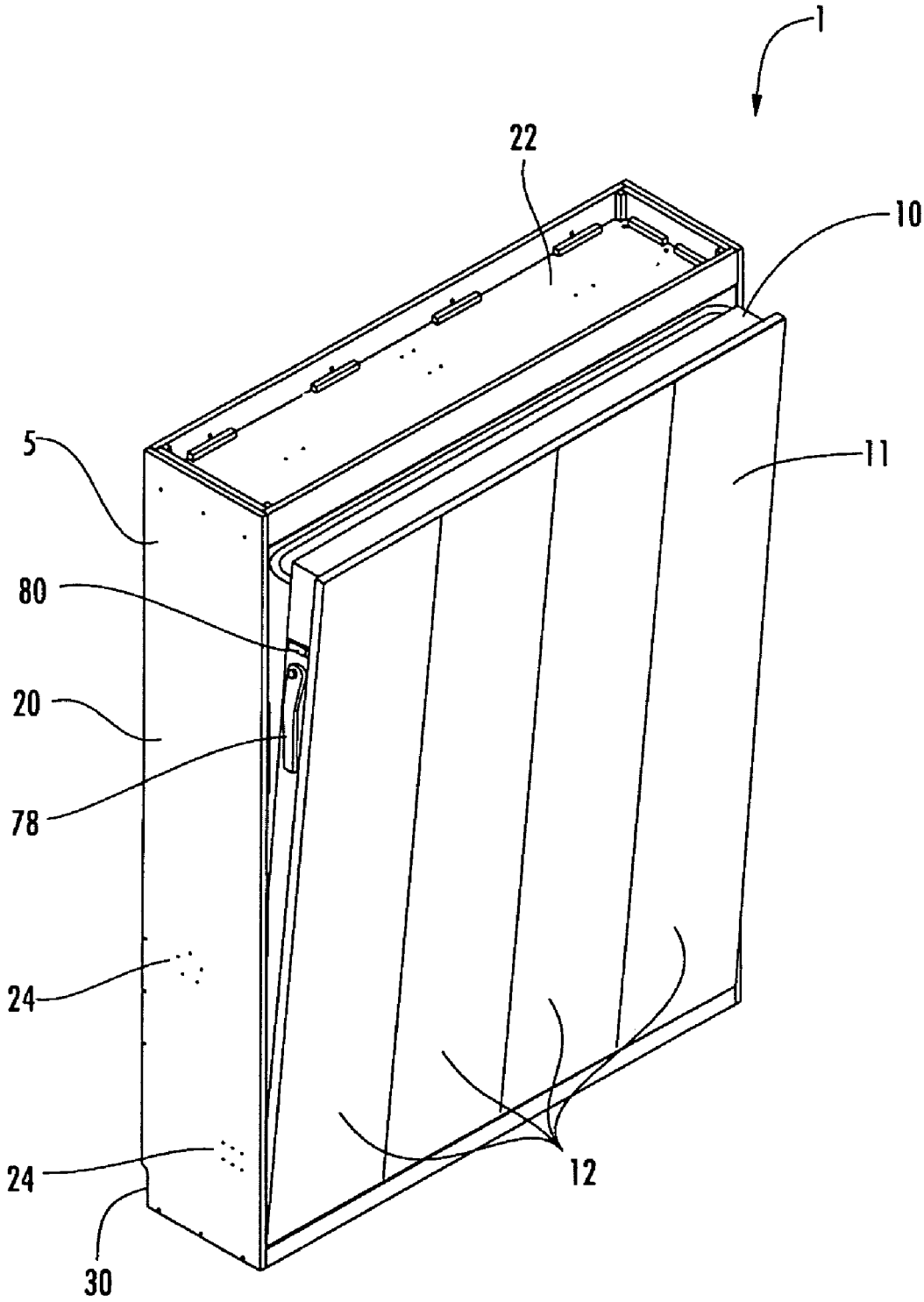
FIG. 12 is a perspective view of the wall bed assembly according to the present invention with the bed frame shown in a safety release position.

The extendable shaft 93 is received within a housing 94 and is retractable therein. An enclosure (not shown) may be provided to surround the extendable shaft 93 and the housing 94. The shaft 93 is biased outwardly from the housing 94 so as to exert outward forces against the foot rail 38 of the bed frame 10. This bias preferably is provided by springs. The outward bias forces of the retractable shaft 93 are overcome by, that is, are less than, the magnetic forces of the retractable magnets 89 such that the bed frame 10 is securely maintained in the vertical position. Upon pressure applied to the exterior of the wall cabinet 5, such as along the upper portion of the anterior panel 11 of the wall cabinet 5, the retractable magnets 89 are urged rearward within the magnet housings 90, thereby releasing the magnetic forces of the magnets 89. This allows the bias forces of the extendable shaft 93 to urge the foot rail 38 forward as shown in FIG. 12. The magnets 89 are biased inwardly but are drawn into an extended position when the bed frame 10 and anterior panel 11 are urged against the extendable shaft 93 and retractable magnets 89 such that the magnetic attraction between the foot rail 30 and the magnets 89 draws the magnets forward. FIG. 13 illustrates the wall bed assembly 1 in the stored position as viewed from the rear of the wall bed assembly 1.

FIG. 12 depicts the wall bed assembly 1 in a safety release position This position results when the foot rail 38 is released by the magnets 89 and urged forward by the extendable shaft 93. The bed frame is released only to this degree due, at least in part, to the counterbalancing forces of the pistons 60. The distance from the vertical is preferably sufficient to prevent gravitational forces to act upon the bed frame, causing the bed frame to continue pivoting downward, toward the horizontal position. This distance can be between one inch and twenty inches, and preferably between two and ten inches, e.g., about six inches.

This novel feature enables the user to press against the anterior panel 11 of the wall cabinet 5 to release the anterior panel 11 and bed frame 10 to the safety release position shown in FIG. 12. The user may then pull the bed frame 10 downward the remainder of the distance to the horizontal position. This is achieved without excessive force due to the counterbalancing effects of the counterbalancing pistons 60. As the bed frame 10 is pivoted towards the horizontal position, the legs 78 pivot to extend generally perpendicular to the side rails 43 of the bed frame 10 so as to support the bed frame 10 upon the floor surface.

To raise the bed frame 10 to the substantially vertical, stored position, the user may grasp any member, e.g., the foot rail 38, bottom of anterior panel 11, etc., to lift the foot of the bed frame 10 to initiate its pivotal movement from the substantially horizontal position to the substantially vertical position. This movement is made relatively effortless due to the counterbalancing effects of the counterbalancing pistons 60 and the unique, relatively lightweight construction of the wall bed assembly I according to the present invention. When raised and pivoted to the substantially vertical position, the retractable magnets 89 attract the foot rail 38, thereby securing the bed frame in the vertical position. Such configuration uniquely prevents unintentional or accidental removal of the bed frame 11 from the wall cabinet 5 and provides a beneficial safety feature.

The convertible bed frame 11 according to the present invention, including the slats 50, may be provided independent of the wall cabinet 5 shown. That is, the bed frame 11 may be inserted into conventional wall cabinets by drilling piston receiving apertures 24 into the side panels. The retractable magnets 89 and extendable shaft 93 and housing 94 may also be provided to be installed in the appropriate locations of a conventional wall cabinet 5. This enables the convertible bed frame 11 of the present invention to be completely customizable, allowing it the flexibility to be positioned within any wall cabinet. Alternatively, the bed frame 11 according to the present invention may be secured to a permanent structure (not shown) such as a wall framed to have a permanent bed frame receiving configuration.

In the drawings and the specification, there has been set forth preferred embodiments of the invention and, although specific terms are employed, the terms are used in a generic and descriptive sense only and not for the purpose of limitation, the scope of the invention being set forth in the following claims.

What is claimed is:

1. A wall bed assembly comprising:

a wall cabinet comprising a pair of side panels and an anterior panel extending between said side panels;

a bed frame secured to an interior surface of said anterior panel and comprising a pair of longitudinally extending side members, wherein said bed frame is pivotally connected to said wall cabinet such that said bed frame pivots from a first, substantially vertical position wherein said bed frame is stored in said wall cabinet and to a second, substantially horizontal position wherein said bed frame and said anterior panel are positioned to support a mattress for use as a bed;

at least one fixed plate secured to at least one of said side panels and comprising an outwardly extending fulcrum member;

at least one counterbalancing piston;

a first bracket attached to said side panel, said first bracket pivotally connecting an upper end of said counterbalancing piston to said side panel of said wall cabinet; and a second bracket secured to the side of at least one of said pair of side members so as to extend upwardly from said bed frame and being pivotally connected to a lower end of said counterbalancing piston, said second bracket comprising a fulcrum receiving aperture positioned above at least one of said pair of longitudinally extending side members for receiving said fulcrum member of said fixed plate whereby said counterbalancing piston, said first and second brackets and said fixed plate secure said bed frame to said wall cabinet side panels and provide a pivotal connection whereby said bed frame is pivoted about said fulcrum member between said first and second positions.

2. A wall bed assembly according to claim 1 wherein said bed frame further comprises a laterally extending head member and a laterally extending foot member wherein said side members and said laterally extending members form a generally rectangular configuration and said wall bed assembly further comprises at least two counterbalancing pistons, at least two fixed plates, at least two first brackets and at least two second brackets for securing each of said bed frame side members to a respective said wall cabinet side panel adjacent said head member.

3. A wall bed assembly according to claim 1 wherein said counterbalancing piston, said first and second brackets and said fixed plate define means for securing said bed frame in a third position, between said first and second positions, wherein said third position is a safety release position and said bed frame is secured in said third position before said bed frame may further pivot to said second position.

4. A wall bed assembly according to claim 3 wherein said safety release position is between about one and twenty inches from the first, substantially vertical position.

5. A wall bed assembly according to claim 4 wherein said safety release position is about six inches from the first, substantially vertical position.

6. A wall bed assembly according to claim 1 wherein said first bracket is circular.

7. A wall bed assembly according to claim 1 wherein said fulcrum member includes a threaded outermost end for receiving securing means to pivotally secure said fixed plate to said second bracket.

8. A wall bed assembly according to claim 1 wherein said second bracket is permanently secured to said bed frame and includes an aperture for receiving an arm of said piston and for pivotally securing said piston to said second bracket.

9. A wall bed assembly according to claim 1 wherein said wall cabinet comprises a posterior surface extending substantially between said pair of side panels.

10. A wall bed assembly according to claim 9 wherein said posterior surface is a posterior brace extending horizontally from one side panel to the other side panel and extending a vertical distance less than the height of said side panels.

11. A wall bed assembly according to claim 10 wherein said wall cabinet further includes an upper surface and a lower surface and said posterior surface extends between said upper and lower surfaces of said wall cabinet.

12. A wall bed assembly according to claim 1 wherein said anterior panel comprises at least two anterior members and said assembly comprises securing means for securing said anterior members.

13. A wall bed assembly according to claim 12 wherein said anterior panel comprises four anterior members.

14. A wall bed assembly according to claim 12 wherein said securing means is a plate for fixedly securing adjacent anterior members.

15. A wall bed assembly according to claim 1 wherein said anterior surface further comprises an anterior surface frame for supporting said bed frame on said anterior surface, said anterior surface frame comprising a plurality of longitudinally extending frame members and a plurality of laterally extending frame members and wherein said bed frame is secured to said anterior surface frame.

16. A wall bed assembly according to claim 15 wherein said anterior panel comprises at least two anterior members, wherein each anterior member comprises at least two of said longitudinally extending frame members and at least three of said laterally extending frame members.

17. A wall bed assembly according to claim 16 wherein each of said anterior members comprises five of said laterally extending frame members.

18. A wall bed assembly according to claim 1 wherein said bed frame comprises a plurality of longitudinal members and a plurality of lateral members, said longitudinal members including said pair of side members and a medial longitudinal member, said lateral members including a laterally extending foot and head member and a medial lateral member, wherein said medial member, said head member, and said foot member each extend between said side members and being secured thereto, and said medial longitudinal member extends between and is secured to said head and foot member and said medial lateral member is secured to said longitudinal member.

19. A wall bed assembly according to claim 18 wherein said side members each comprise a plurality of apertures and said bed frame further comprises a plurality of mattress supporting slats wherein a distal end of said slats are received within said apertures.

20. A wall bed assembly according to claim 19 further comprising a plurality of bushings configured to be received within said side member apertures to receive said distal ends of said slats.

21. A wall bed assembly according to claim 19 further comprising a plurality of brackets for receiving medial ends of said slats for securing said slats to said longitudinally extending frame member.

22. A wall bed assembly according to claim 1 wherein said bed frame further comprises a pair of longitudinally extending side members, a laterally extending head member and a laterally extending foot member, and a foot rail extending from said foot member; and wherein said wall cabinet further comprises an upper surface extending between said side panels and having at least one magnet for cooperating with said foot rail, said upper surface also comprising releasing means for releasing said foot rail from said at least one magnet.

23. A wall bed assembly according to claim 22 wherein said at least one magnet is positioned within a housing and is retractable from a first position extending outwardly from said housing to cooperate with said foot rail and a second position within said housing and wherein said magnet is biased toward said second position and magnetic attraction from said foot rail being pivoted toward said magnet housing draws said magnet to said first position and wherein said releasing means is an extendable shaft wherein said shaft is biased forward so as to urge against said foot rail when said foot rail is released from said magnet.

24. A wall bed assembly according to claim 1 further wherein said bed frame comprises a pair of longitudinally extending side members secured to said anterior panel and said bed frame comprises at least two legs, each of said legs being pivotally secured to each of said side members for supporting said bed frame and said anterior panel in said second position, said legs being pivotally secured to said side members by securing means for permitting said legs to freely pivot as said bed frame is pivoted between said first and second positions, and wherein when said bed frame is in said first position, said leg extends substantially parallel to and along a length of said bed frame side member and when said bed frame is in said second position, said leg extends generally perpendicular to said bed frame side member.

25. A wall bed assembly according to claim 24 wherein each of said bed frame side member comprises an outwardly extending stop for cooperating with said at least one leg to prevent over rotation of said leg.

26. A wall bed assembly according to claim 24 wherein each of said legs includes an outer edge defining an obtuse angle, generally between 95° and 175°.

27. A wall bed assembly comprising:

a wall cabinet comprising a pair of side panels and an anterior panel extending between said side panels;

a bed frame secured to said anterior panel wherein said bed frame is pivotally connected to said wall cabinet such that said bed frame pivots from a first, substantially vertical position wherein said bed frame is stored in said wall cabinet to a second, substantially horizontal position wherein said bed frame is positioned to support a mattress for use as a bed wherein said bed frame comprise a plurality of longitudinal members and a plurality of lateral members, said longitudinal members including at least a pair of side members and said lateral members includes at least a laterally extending head and foot member wherein said longitudinal members and said lateral members form a generally rectangular configuration;

a foot rail extending from said foot member; and wherein said wall cabinet further comprises an upper surface extending between said side panels and having at least one magnet for cooperating with said foot rail, said upper surface also comprising releasing means for releasing said foot rail from said at least one magnet.

28. A wall bed assembly according to claim 27 wherein said at least one magnet is positioned within a housing and is retractable from a first position extending outwardly from said housing to cooperate with said foot rail and a second position within said housing.

29. A wall bed assembly according to claim 28 wherein said magnet is biased toward said second position and magnetic attraction from said foot rail being pivoted toward said magnet housing draws said magnet to said first position.

30. A wall bed assembly according to claim 27 wherein said upper surface of said wall cabinet comprises at least two of said retractable magnets.

31. A wall bed assembly according to claim 27 wherein said releasing means is an extendable shaft wherein said shaft is biased forward so as to urge against said foot rail when said foot rail is released from said magnet.

32. A bed frame assembly comprising:

a bed frame for mounting to a wall structure and for supporting a mattress, said bed frame being generally rectangular and having a pair of side members and head and foot members;

a pivot bracket fixedly secured to the side of at least one of said pair of said bed frame side members so as to extend upwardly from each side member, adjacent said head member, and comprising a first aperture and a second aperture;

a counterbalancing piston pivotally having a bottom portion connected to each of said pivot brackets and having an arm extending outwardly there from, wherein said arm extends through said first aperture and is secured with securing means for pivotally connecting the bottom portion of said counterbalancing piston to said pivot bracket;

an upper bracket pivotally connected to an upper end of said counterbalancing piston; and a plate comprising a fulcrum member extending outwardly there from, said fulcrum member extending through said second aperture at a position above one of said pair of side members, said assembly further comprising securing means for pivotally securing said pivot bracket to said plate.

33. A bed frame assembly according to claim 32 further comprising at least two legs, one of each of said at least two legs is pivotally secured to each of said side members for supporting said bed frame, said legs being pivotally secured to said side members by securing means for permitting said legs to freely pivot as said bed frame is pivoted, and wherein said leg may be positioned so as extend substantially parallel to and along a length of said bed frame side member and so as to extend generally perpendicular to said bed frame side member.

34. A bed frame assembly according to claim 33 wherein said legs are non-linear.

* * * * *